United States Patent [19]

Wyckoff

[11] Patent Number: 4,969,713

[45] Date of Patent: Nov. 13, 1990

[54] MARKER STRIP SURFACE FOR ROADWAYS AND THE LIKE

[75] Inventor: Charles W. Wyckoff, Needham, Mass.

[73] Assignee: Brite Line Corporation, W. Roxbury, Mass.

[21] Appl. No.: 283,192

[22] Filed: Dec. 12, 1988

[51] Int. Cl.[5] ..... G02B 5/136; G02B 5/128

[52] U.S. Cl. ..... 350/109; 350/105; 404/14

[58] Field of Search ..... 350/103, 105, 106, 107, 350/109; 404/9, 10, 12, 13, 14, 93, 94

[56] References Cited

U.S. PATENT DOCUMENTS

| | | | |
|---|---|---|---|
| 3,920,346 | 11/1975 | Wyckoff | 404/14 |
| 4,040,760 | 8/1977 | Wyckoff | 404/14 |
| 4,069,281 | 1/1978 | Eigenmann | 350/105 |
| 4,069,787 | 1/1978 | Wyckoff | 116/63 R |
| 4,145,112 | 3/1979 | Crone et al. | 350/103 |
| 4,236,788 | 12/1980 | Wyckoff | 350/97 |
| 4,681,401 | 7/1987 | Wyckoff | 350/105 |
| 4,758,469 | 7/1988 | Lange | 350/105 |

FOREIGN PATENT DOCUMENTS

| | | | |
|---|---|---|---|
| 2936317 | 3/1981 | Fed. Rep. of Germany | 404/93 |

*Primary Examiner*—Bruce Y. Arnold
*Assistant Examiner*—Ronald M. Kachmarik
*Attorney, Agent, or Firm*—Shapiro and Shapiro

[57] ABSTRACT

An improved retro-reflective beaded roadway marker strip and the like, formed of successive spaced segmented wedges as rows of trapezoidal blocks containing retro-reflective beads at least on their inclined front, side and rear surfaces and with the blocks of successive rows staggered; the strip being preferably formed of a bottom rubber-like non-memory surface and an upper crosslinked elastomeric self-restoring surface.

9 Claims, 3 Drawing Sheets

MARKER STRIP SURFACE FOR ROADWAYS AND THE LIKE

BACKGROUND OF THE INVENTION

The present invention relates to the provision of distinctive marking in the directions of travel on motoring highways, airports and other surfaces with the aid of thin marker strips adhered to the traveling or other surfaces, and employing successively spaced wedges provided sometimes with retro-reflective materials and other times with only diffusely reflecting surfaces; the invention being more particularly concerned with improved marker strips for such and related purposes.

In my earlier U.S. Letters Patent No. 4,681,401 issued on July 21, 1987, an effective improved thin surface marking strip for adhering to a road surface or the like is disclosed embodying novel somewhat flattened, wedges having retroflective material and of preferably substantially trapezoidal shape in longitudinal vertical section (longitudinally of the strip) with rather critical separations between the wedges relative to height and width of the wedges to obviate shadowing effects, as in sunlight, to provide improved daylight observation, and to increase effectiveness and life, particularly under conditions of rain-covered surfaces and snow. Earlier art dealing with this type of technology is disclosed in U.S. Letters Patent Nos. 4,236,788; 4,069,787; 4,040,760 and 3,920,346.

While the marker strips of my earlier U.S. Pat. No. 4,681,401 have been particularly promising, certain difficulties have been encountered in testing under the more strenuous conditions of use, including heavy rainfall and heavy snow, and the practical considerations of the use of heavy vehicle traffic and of snow removal plows and similar implementations in the colder climates. In particular, it has been found that the necessary spacing between successive transverse wedges having retro-reflective material on the inclined trapezoidal front and leading surfaces of the wedges in order to prevent the obscuring of the strips by the shadows that they cast in sunlight, have had some practical problems in some instances with the snowplow blades catching in the horizontal longitudinally extending spaces between the wedges, which introduces wear and damage problems that were not anticipated. In addition, the severe use of the device, particularly after wear, has been found to reduce the effectiveness of visibility under wet conditions, which has given rise to a further feature of the present invention in terms of rather critical height dimensions to the wedges.

SUMMARY OF THE INVENTION

In accordance with the present invention, it has been found that the advantages of the appropriate spacing between the wedges can be retained to prevent obscuring of the strip by shadows in daylight by interposing between the alternate wedges an intermediate wedge; and that for purposes of providing a wider angle and indeed a somewhat omni-directionality to retroflection to incident light, as from headlights or sidelighting at night, as well as to visibility in daytime, these wedges are preferably broken up or segmented or interrupted to form lines or rows of blocks preferably of rather critical rectangular proportions and spacings, as later explained. This technique has been found admirably not only to limit the deleterious effects of heavy snowplow digging and the like, but also to enable the maintenance of alternate wedge separations at sufficient to prevent the before-described serious shadowing and potential obscuring of the strip by the shadows of the wedges, and simultaneously to prevent the catching of the snowplow in spaces between wedges. Other improvements have also been found to result from this novel construction and are hereinafter pointed out.

In summary, however, from one of its viewpoints, the invention provides for use with a roadway surface and the like, a direction-indicating surface marker strip comprising a bottom rubber-like (non-memory) surface for adhering to the roadway and an upper crosslinked plastic elastomeric self-restoring (polyurethane, PVC, polycarbonate, epoxy, rubber, etc.) surface, said upper surface of said strip being intermittently deformed upwardly to provide successive longitudinally spaced wedges of substantially trapezoidal shape in longitudinal vertical section, and each interrupted or segmented transversely to divide the wedge into a plurality of similar blocks of substantially trapezoidal shape in longitudinal vertical section; each block of each wedge having a substantially horizontal top surface bounded by inclined front, rear and side surfaces and of substantially rectangular perimeter, with the area substantially greater than the area of each of the inclined surfaces and the rectangle being longer in the longitudinal direction to minimize the effect of shadowing and causing maximum light visibility in daylight; the blocks of each wedge being staggered transversely from the blocks of adjacent wedges, with the corresponding blocks of alternate wedges being separated by substantially horizontal surfaces of longitudinal extent more than twice the longitudinal dimension of said block top surface; one or more of the wedge block front, rear and side inclined surfaces carrying a layer of exposed retro-reflective glass microspheres; the blocks providing substantially omni-directional retro-reflection to incident light and the blocks of intermediate wedges between the blocks of alternate wedges limiting snowplow digging and the like, while enabling the wedges to be sufficiently longitudinally spaced to prevent obscuring of the strip by shadows of the wedges.

Preferred embodiments and best mode constructions are hereinafter detailed.

BRIEF DESCRIPTION OF THE DRAWINGS

The invention will now be described in connection with the accompanying drawings, FIG. 1*a* of which is an isometric view of a fragment of the marker strip constructed in accordance with the invention with retro-reflective beads illustratively sparsely shown, though understood to be throughout the structure.

DETAILED DESCRIPTION OF THE PREFERRED EMBODIMENTS

Figure 1:
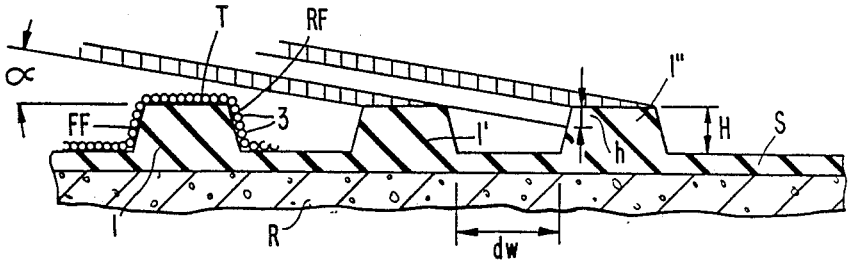
FIGS. 1, 2 and 3 are similar longitudinal sections of the strip with successively increasing flat space dimensions between lines of wedge blocks, showing incident light-ray impingement.
Figure 1A:
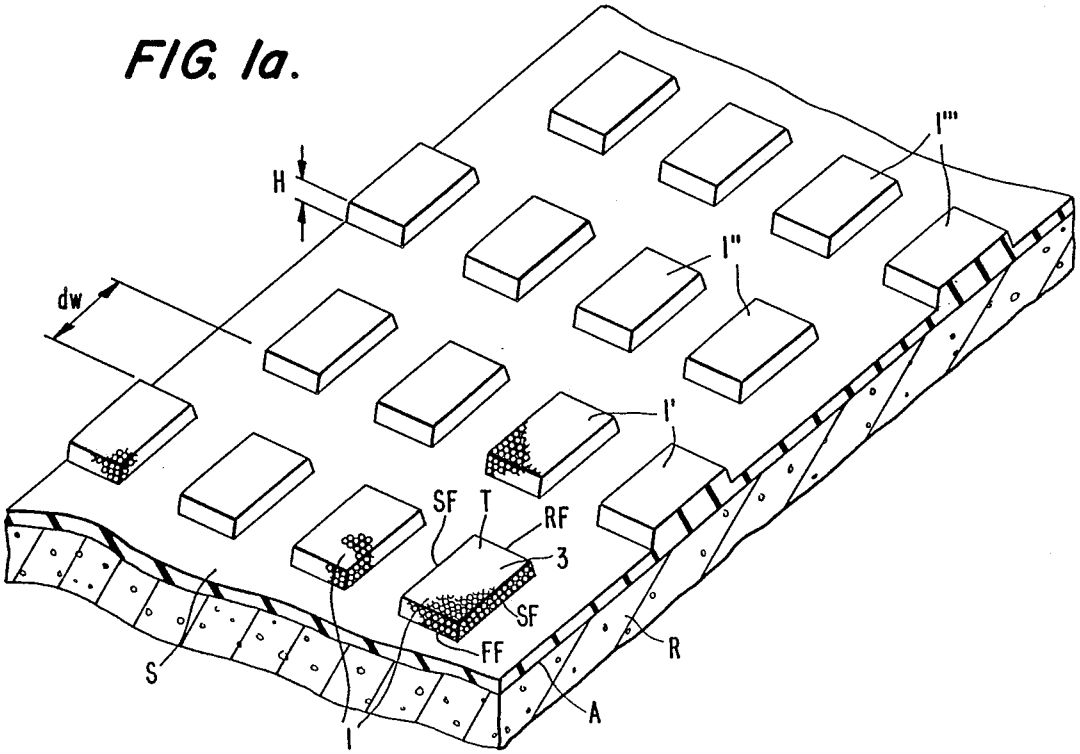

Referring to the drawings, FIG. 1*a* shows generally the marker strips S of the invention secured as by adhesive A to a roadway R and containing successive longitudinally spaced transverse wedges, each segmented or interrupted transversely into a plurality of blocks——the front wedge blocks 1; the next wedge blocks 1'; the next wedge blocks 1''; the next, at 1''', etc. Each wedge block is preferably of substantially trapezoidal shape in longitudinal and transverse vertical section (FIGS. 1–6) and each has front, rear and side inclined surfaces shown in FIG. 1 at FF, RF and SF, respectively, carrying a layer of exposed retro-reflective glass beads 3, and with the blocks of each wedge, being staggered transversely from the blocks of adjacent wedges. As is later more evident, each wedge block has a flat top surface T bounded by the said inclined front, rear and side surfaces (FF, RF, SF, respectively) and of substantially rectangular perimeter, with the area substantially greater than the area of each of the inclined surfaces. The top surface T may have dimensions of, for example, 0.20×0.30 inches; the front and rear inclined surfaces FF and RF, 0.05×0.20 inches. The block rectangle is longer in the longitudinal direction to minimize the effect of shadowing and to provide maximum light visibility in daylight.

It has been found that viewing from an oncoming car can be achieved at greater distances as the longitudinal wedge separation dw increases, as will be explained in connection with FIGS. 1 through 3. It is thus more advantageous to have as great a wedge longitudinal separation dw as feasible, since the farther the wedge rows 1–1'-1''-1''', etc. are separated, the farther down the inclined surface of the wedge blocks the oncoming car driver can see at a given distance. This is critical, because as the beads wear away from the top T in use, the corners tend to round and that limits visibility. On the other hand, the farther apart these wedges become, the more chance there is for a snowplow to drop in, as before discussed. The staggered blocks of wedges 1–1'–1''–1''', etc., however, greatly minimize that effect.

Figure 2:
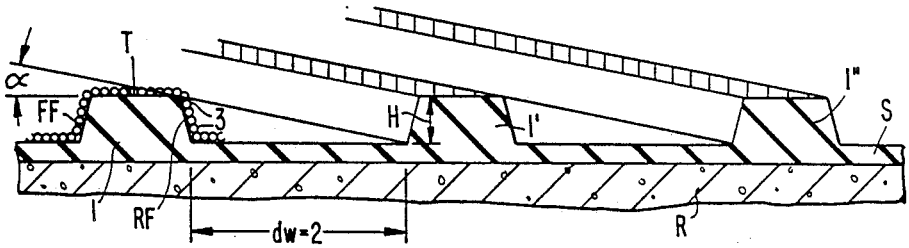
Figure 3:
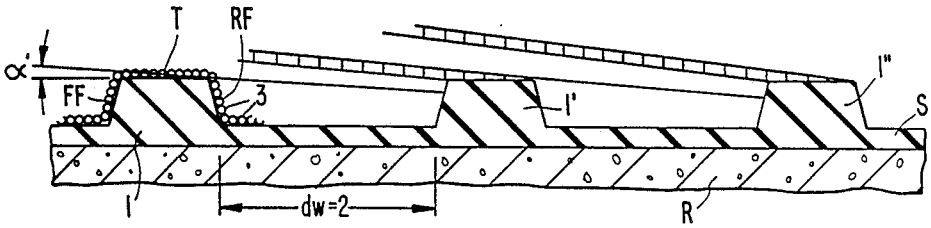

In FIGS. 1–3, the observation angle of the oncoming car observer (light rays shown in shaded and non-shaded tones), is labelled $\alpha$ and the longitudinal separation distance between wedges as the before-described distance dw. The separation distance dw increases from dw=1 in FIG. 1 to dw=2 in FIGS. 2 and 3. It will be observed that from the same viewing angle $\alpha$, the visible height of the beads on the front sides F of the wedges in FIG. 1 is h, less than the full wedge height H; but the full height h=H can be seen in FIG. 2 with its dw=2 separation. The greater separation dw=2 (actually, for example, about 0.700 inch, more than twice the longitudinal dimension of the horizontal top surfaces of the wedge blocks) further permits initial viewing or pick-up by the car operator at a greater distance than in FIG. 1, as is evident from the lower viewing angle $\alpha$ in FIG. 3; i.e., greater range of pick-up.

The minimum height H of these wedges, in accordance with the invention, is, for example, about 0.050 inch, this having been found to be rather critical, since it has been determined that, in operation, the average film of water collected during rainstorms is of the order of 0.040 inch thick.

Figure 4:
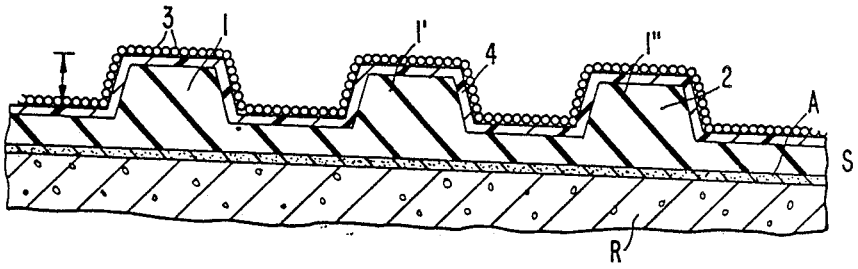
FIGS. 4, 5 and 6 are similar views of modified strip construction, FIG. 4 illustrating a wedge-deformed rubber strip with a top coating as of polyurethane, polycarbonate, PVC or similar material, FIG. 5 illustrating a PVC base strip, and FIG. 6 showing open-mesh cloth sandwiched between the rubber base and adhesive layers.

Turning to practical and useful constructional details of the marker sheets of such construction, FIG. 4 is a transverse cross-section in which a preferably "non-memory" surface as of a rubber-base sheet 2 is employed that is deformed upward into the rows of interrupted staggered trapezoidal wedge block wedges 1, 1'. 1'', etc. A cover or top coat 4 is provided of a cross-linked elastomeric self-restoring plastic surface layer, say of the order of 0.002–0.004 inch, as of polyurethane or polycarbonate or epoxy or PVC or similar coating, with the beads 3 protruding, preferably being embedded about 60 percent, and with an adhesive layer A on the bottom of the strip to adhere to the roadway R. Suitable adhesives are butyl or nitrile rubber pressure-sensitive materials.

Figure 5:
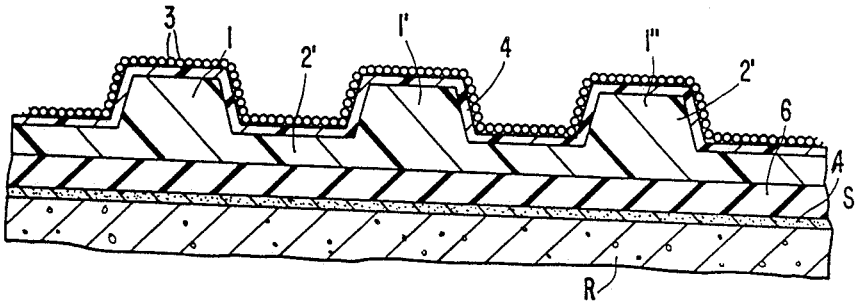

FIG. 5 illustrates a somewhat similar construction, except that instead of a rubber base that protrudes upwards, a PVC or similar base 2' is employed with a very thin valley floor of the order of 0.002–0.004" thick. Beneath the PVC base strip of protruding wedges in the embodiment of FIG. 5, is a non-memory rubber base strip 6, with the adhesive layer A adhering the product to the roadway R.

Figure 6:
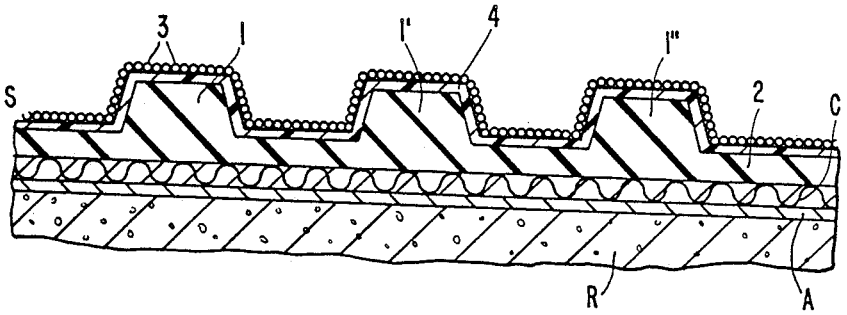

The modification of FIG. 6 is similar to FIG. 4, except that between the adhesive A and the rubber base 2 with its protruding wedges 1–1'–1'', etc., is sandwiched an open-mesh cloth C as an aid in processing, since the rubber base may lack sufficient strength, once deformed into the wedge protruberances. In order to prevent too much strength that might lose conformability of the strip, an open mesh cloth is preferred.

While for inexpensive versions, the glass beads 3 may just be pushed into the surface of the strip, for longer lasting and more desirable products, the topcoat 4 is provided. Considering a polyurethane topcoat, which is a solvent-based material, either water-based or some other solvent, the topcoat is spread onto the rubber base material and before it dries, the beads are embedded over the entire surface. When the solvent is dried out, it is ready for embossing of the wedges unless the embossing was performed prior to application of the topcoat. Alternative topcoats may be acrylic or epoxy, or a combination of both which become solidified by chemical action. Once solid, the beads 3 are anchored and there is now provided by this topcoated product a tough, wear-resistant layer which tends to hold the shape of the interrupted wedges or ridges a bit more than would be the case for just rubber, which lacks memory and has cold flow characteristics. There is, however, a delicate balance here, because if too much topcoat is employed, cold flow will be lost and with it the desired degree of conformability.

In such construction, retroflective beads will cover all surfaces of the wedge blocks, including the top surfaces T and the horizontal surfaces between blocks. Where the beads are later embedded, selection of the surfaces to be provided with beads can be made, with none provided at T or in the surfaces between wedge blocks if desired; and, indeed, in some applications, a diffuse reflection surface may be substituted for the beads if brilliant retroreflection is not desired.

With the wedges as disclosed in my earlier U.S. Letters Pat. No. 4,681,401, the valleys in between the wedges can be made very thin to enable the marker strip to be readily conformable in one dimension, but not orthogonally thereto ——the ridges or wedges preventing the conformability in that direction. By interrupting these wedges by spaces, again with a thin valley floor, in accordance with the staggered wedge block construction of the invention, conformability in the orthogonal and thus in all directions is obtainable. The advantage of having the PVC wedges of FIG. 5 (or solid polyurethane or polycarbonate) over the straight rubber base wedge of FIG. 4 is that it will provide a better, longer wear characteristic. It is a tougher material, obviously, than the non-crosslinked rubber with its cold flow characteristics.

Further modifications will also occur to those skilled in this art and such are considered to fall within the spirit and scope of the invention as defined in the appended claims.

What is claimed is:

1. For use with a roadway surface and the like, a direction-indicating surface marker strip comprising a bottom rubber-like substantially non-memory surface for adhering to the roadway and an upper crosslinked elastomeric self-restoring surface, said upper surface of said strip being intermittently deformed upward to provide successive longitudinally spaced wedges of substantially trapezoidal shape in longitudinal vertical section, and each interrupted or segmented transversely to divide the wedge into a plurality of similar blocks of substantially trapezoidal shape in longitudinal vertical section, each block of each wedge having a substantially horizontal top surface bounded by inclined front, rear and side surfaces and of substantially rectangular perimeter with the area substantially greater than the area of each of the inclined surfaces, the rectangle being longer in the longitudinal direction to minimize the effect of shadowing and providing maximum light visibility in daylight, the blocks of each wedge being staggered transversely from the blocks of adjacent wedges, with the corresponding blocks of alternate wedges being separated by substantially horizontal surfaces of longitudinal extent more than twice the longitudinal dimension of said block top surface, each of the front, rear and side inclined block surfaces carrying a layer of exposed retro-reflective beads, the retro-reflection from inclined front, rear and side surfaces of the blocks providing substantially omni-directional retro-reflection to incident light and the intermediate wedges between alternate wedges limiting snowplow digging and the like, while enabling the blocks of alternate wedges to be sufficiently longitudinally spaced to prevent obscuring of the strip by shadows of the wedges.

2. A direction-indicating surface marker strip as claimed in claim 1 and in which the upper elastomeric surface is selected from the group consisting of polyurethane, PVC, polycarbonate and epoxy resins and rubber.

3. A direction-indicating surface marker strip as claimed in claim 1 and in which the wedge blocks are of about 0.300 inch in longitudinal dimension, about 0.200 inch in transverse dimension width and of height greater than about 0.040 inch for wet visibility.

4. A direction-indicating surface marker strip as claimed in claim 3 and in which said longitudinal extent of the horizontal surfaces between corresponding blocks of alternate wedges are about 0.700 inch.

5. A direction-indicating surface marker strip as claimed in claim 1 and in which an open mesh cloth is sandwiched within the strip.

6. A direction-indicating marker strip as claimed in claim 1 and in which the said block horizontal top surfaces are also provided with retro-reflective beads.

7. A direction-indicating marker strip as claimed in claim 1 and in which said horizontal surfaces separating corresponding blocks of alternate wedges are also provided with retro-reflective beads.

8. A direction-indicating marker strip as claimed in claim 1 and in which the retroreflective beads on one or more surfaces are replaced by diffuse reflective surfaces.

9. For use with a roadway surface and the like, a direction-indicating surface marker strip comprising a bottom rubber-like surface for adhering to the roadway and an upper surface intermittently deformed upward to provide successive longitudinally spaced wedges of substantially trapezoidal shape in longitudinal vertical section and each interrupted or segmented transversely to divide the wedge into a plurality of similar blocks of substantially trapezoidal shape in longitudinal vertical section, each block of each wedge having a substantially horizontal top surface surrounded by inclined front, rear and side surfaces of substantially rectangular perimeter with the area substantially greater than the area of each of the inclined surfaces, the rectangle being longer in the longitudinal direction to minimize the effect of shadowing and providing maximum light visibility in daylight, being staggered transversely from the blocks of adjacent wedges, with the corresponding blocks of alternate wedges being separated by substantially horizontal surfaces of longitudinal extent more than twice the longitudinal dimension of said block top surface, each of the front, rear and side inclined block surfaces carrying a layer of exposed retro-reflective beads, the retro-reflection from inclined front, rear and side surfaces of the blocks providing substantially omni-directional retro-reflection to incident light and the intermediate wedges between alternate wedges limiting snowplow digging and the like, while enabling the blocks of alternate wedges to be sufficiently longitudinally spaced to prevent obscuring of the strip by shadows of the wedges.

* * * * *